US008004205B2

(12) United States Patent
Lin et al.

(10) Patent No.: US 8,004,205 B2
(45) Date of Patent: Aug. 23, 2011

(54) BACKLIGHT MODULE CONTROL SYSTEM WHOSE TWO BACKLIGHT SUB-MODULES ARE IN A CLOSED LOOP

(75) Inventors: Chi-Hsiu Lin, Yun-Lin Hsien (TW); Wei-Wen Chung, Taoyuan County (TW); Chien-Yang Chen, Taipei (TW); Shih-Hen Chao, Taoyuan County (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 359 days.

(21) Appl. No.: 12/345,689

(22) Filed: Dec. 30, 2008

(65) Prior Publication Data

US 2010/0007288 A1 Jan. 14, 2010

(30) Foreign Application Priority Data

Jul. 8, 2008 (TW) ..... 97125693 A

(51) Int. Cl.
*H05B 41/16* (2006.01)

(52) U.S. Cl. ..... 315/282; 315/274; 315/224; 315/209 R; 315/312

(58) Field of Classification Search ..... 315/282, 315/274–278, 246, 209 R, 312–325, 224, 315/225

See application file for complete search history.

(56) References Cited

U.S. PATENT DOCUMENTS

| | | | | |
|---|---|---|---|---|
| 7,239,087 | B2 | 7/2007 | Ball | |
| 7,309,964 | B2 * | 12/2007 | Wey et al. | 315/312 |
| 7,432,669 | B2 * | 10/2008 | Ahn et al. | 315/312 |
| 7,667,411 | B2 * | 2/2010 | Kim et al. | 315/282 |
| 2004/0155596 | A1 | 8/2004 | Ushijima et al. | |
| 2006/0197466 | A1 | 9/2006 | Park | |

* cited by examiner

*Primary Examiner* — Tuyet Thi Vo

(74) *Attorney, Agent, or Firm* — Winston Hsu; Scott Margo

(57) ABSTRACT

A backlight module control system includes a power supply, a first backlight sub-module, a second backlight sub-module, a first transformer and a second transformer. The power supply is utilized for providing an operating power to the backlight module control system. A primary side and a secondary side of the first transformer are respectively coupled to the power supply and a first node of the first backlight sub-module. A primary side of the second transformer is coupled to the power supply, and a secondary side of the second transformer is coupled to the secondary side of the second transformer and a first node of the second backlight sub-module.

9 Claims, 8 Drawing Sheets

BACKLIGHT MODULE CONTROL SYSTEM WHOSE TWO BACKLIGHT SUB-MODULES ARE IN A CLOSED LOOP

BACKGROUND OF THE INVENTION

1. Field of the Invention

The present invention relates to a backlight module control system, and more particularly, to a backlight module control system having a plurality of backlight sources.

2. Description of the Prior Art

Please refer to FIG. 1. FIG. 1 is a diagram illustrating a prior art backlight module control system 100. As shown in FIG. 1, the backlight module control system 100 includes an inverter 110 and a plurality of backlight sources 120_1-120_8, where the inverter 110 includes four output nodes and each output node is connected to two backlight sources. In the operation of the backlight module control system 100, in order to ensure a uniform luminance of a display panel, the luminance of each backlight source is required to be the same; that is, a current of each backlight source needs to be as similar as possible.

Because the conventional backlight source is a cold cathode fluorescent lamp (CCFL), and the CCFL has a negative resistance characteristic, when the current of the backlight source 120_1 increases, the temperature of the backlight source 120_1 also increases, and the resistance of the backlight source 120_1 decreases due to the increased temperature. Because the output voltages of the inverter 110 are constant, however, the current of the backlight source 120_1 continuously increases due to the decreased resistance. In addition, the backlight module control system 100 generally has a maximum output power limitation; that is, a limitation of the total currents of all the backlight sources. Therefore, if the current of the backlight source 120_1 continuously increases, the current of the backlight source 120_2 will decrease, further causing different luminance between each backlight source, causing the luminance-uniformity of the display panel to be degraded.

To solve the above-mentioned non-uniform luminance of the display panel, an external circuit is used to ensure that each backlight source has the same current. FIG. 2 is a diagram illustrating a backlight module control system 200 using transformers to balance the currents of the backlight sources. As shown in FIG. 2, the backlight module control system 200 includes a voltage source 202, a plurality of backlight sources 210 and a plurality of transformers 220. Primary sides of the transformers 220 are respectively connected to the backlight sources 210, and secondary sides of the transformers 220 are connected in series. Because the secondary sides of the transformers 220 are connected in series, the secondary side coils of the transformers 220 have the same current $I_s$, further inducing the current $I_p$ of the backlight sources 210 to be the same. In addition, a prior art backlight module control system 300 using capacitors to balance the current of the backlight source shown in FIG. 3 and a prior art backlight module control system 400 using inductors to balance the current of the backlight source shown in FIG. 4 can also be applied to solve the above-mentioned non-uniform luminance of the display panel issue. In addition, the backlight module control system 300 includes a driving circuit 302, a transformer 320, a plurality of backlight sources 310 and a plurality of capacitors $C_1$-$C_8$; and the backlight module control system 400 includes a driving circuit 402, a transformer 420, a plurality of backlight sources 410, a plurality of inductors $L_1$-$L_4$ and a plurality of capacitors $C_1$-$C_4$.

Because the above-mentioned backlight module control system 200, 300 and 400 need external circuits, the complexity of the inverter and the manufacturing cost are increased.

SUMMARY OF THE INVENTION

It is therefore an objective of the present invention to provide a backlight module control system capable of balancing the current of backlight sources without using external circuits or only using few electrical components, to solve the above-mentioned problems.

According to one embodiment of the present invention, a backlight module control system comprises a power supply, a first backlight sub-module, a second backlight sub-module, a first transformer and a second transformer. The power supply is utilized for providing an operating power to the backlight module control system. A primary side and a secondary side of the first transformer are respectively coupled to the power supply and a first node of the first backlight sub-module. A primary side of the second transformer is coupled to the power supply, and a secondary side of the second transformer is coupled to the secondary side of the second transformer and a first node of the second backlight sub-module.

These and other objectives of the present invention will no doubt become obvious to those of ordinary skill in the art after reading the following detailed description of the preferred embodiment that is illustrated in the various figures and drawings.

DETAILED DESCRIPTION

Figure 5:
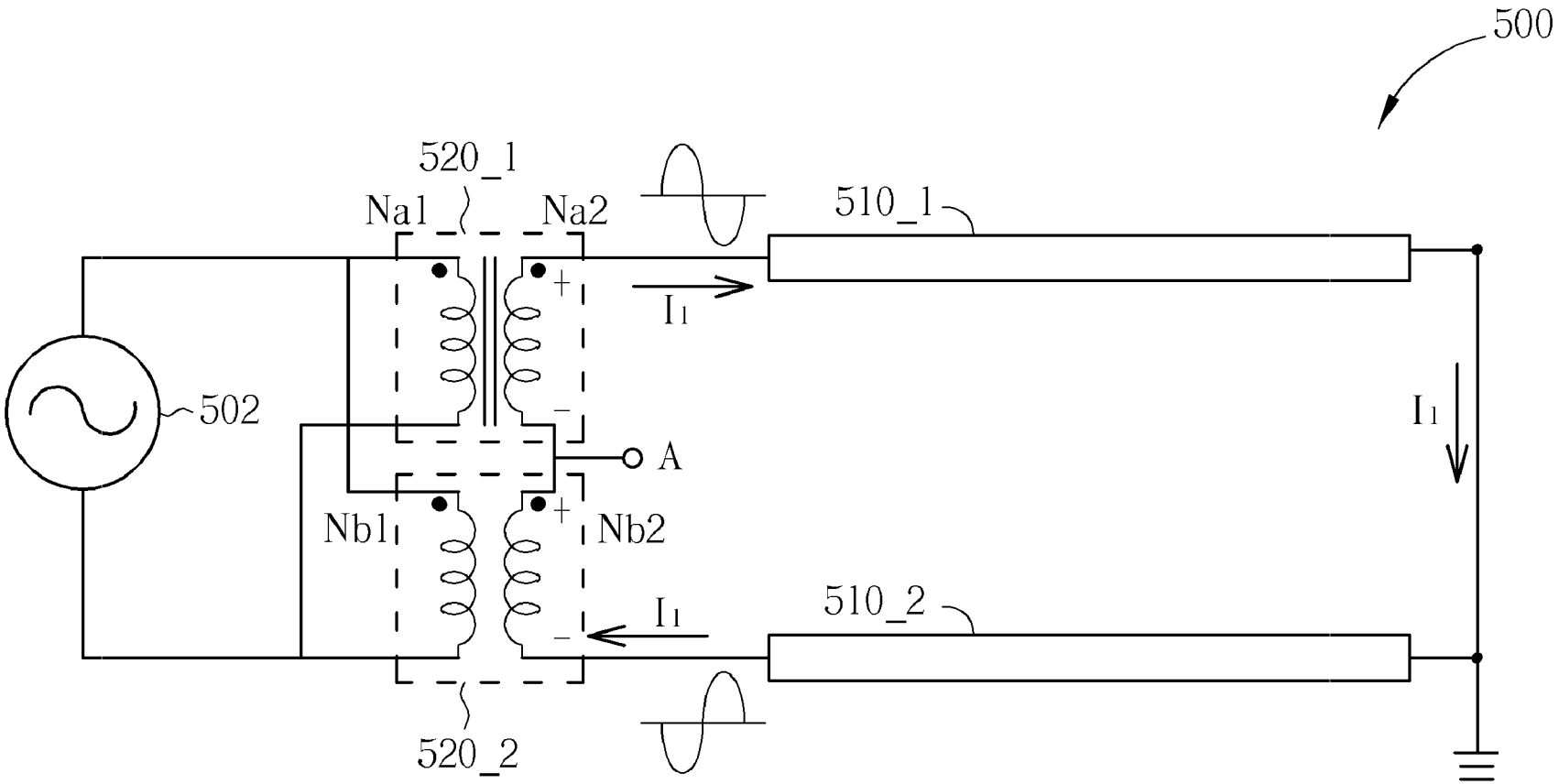
FIG. 5 is a diagram illustrating a backlight module control system according to a first embodiment of the present invention.

Please refer to FIG. 5. FIG. 5 is a diagram illustrating a backlight module control system 500 according to a first embodiment of the present invention. As shown in FIG. 5, the backlight module control system 500 includes a power supply 502, two backlight sub-modules (in this embodiment, two backlight sources 510_1 and 510_2 serve as the two backlight sub-modules), and two transformers 520_1 and 520_2. A primary side and a secondary side of the transformer 520_1 are respectively coupled to the power supply 502 and a first node of the backlight source 510_1. A primary side of the transformer 520_2 is connected to the power supply 502, and a secondary side of the transformer 520_2 is connected to the secondary side of the transformer 520_1 and a first node of the backlight source 510_2. In addition, a positive connection of the secondary side of the transformer 520_1 is coupled to the backlight source 510_1, a negative connection of the secondary side of the transformer 520_2 is coupled to the backlight source 510_2, and a negative connection of the secondary side of the transformer 520_1 is coupled to a positive connection of the secondary side of the transformer 520_2. Please note that a number of the backlight sources shown in FIG. 5 is for illustrative purposes, and is not meant to be a limitation of the present invention.

In the backlight module control system 500, when turns ratios of the transformers 520_1 and 520_2 are the same (i.e., Na2/Na1=Nb2/Nb1), because of the same voltage of the primary sides of the transformers 520_1 and 520_2, the voltage of the secondary sides of the transformers 520_1 and 520_2 are the same (i.e., a node A shown in FIG. 5 is virtual ground). In addition, the backlight sources 510_1 and 510_2, and the secondary sides of the transformers 520_1 and 520_2 form a closed loop, and have the same current. That is, the backlight sources 510_1 and 510_2 have the same current $I_1$. According to the above descriptions, the backlight module control system 500 of the present invention can balance the current of the backlight sources without any external electrical component such as the transformer, capacitor or inductor, which further improves the luminance uniformity of the display panel.

It is noted that the positive and negative connections of the secondary sides of the transformers 520_1 and 520_2 can also be arranged as follows: the negative connection of the secondary side of the transformer 520_1 is coupled to the backlight source 510_1, the positive connection of the secondary side of the transformer 520_2 is coupled to the backlight source 510_2, and the positive connection of the secondary side of the transformer 520_1 is coupled to the negative connection of the secondary side of the transformer 520_2. The backlight sources 510_1 and 510_2 therefore have the same current.

In addition, in the backlight module control system 500, second sides of the backlight sources 510_1 and 510_2 are connected to ground. The second sides of the backlight sources 510_1 and 510_2 can also be connected to each other, however, and not connected to other voltage levels.

Figure 6:
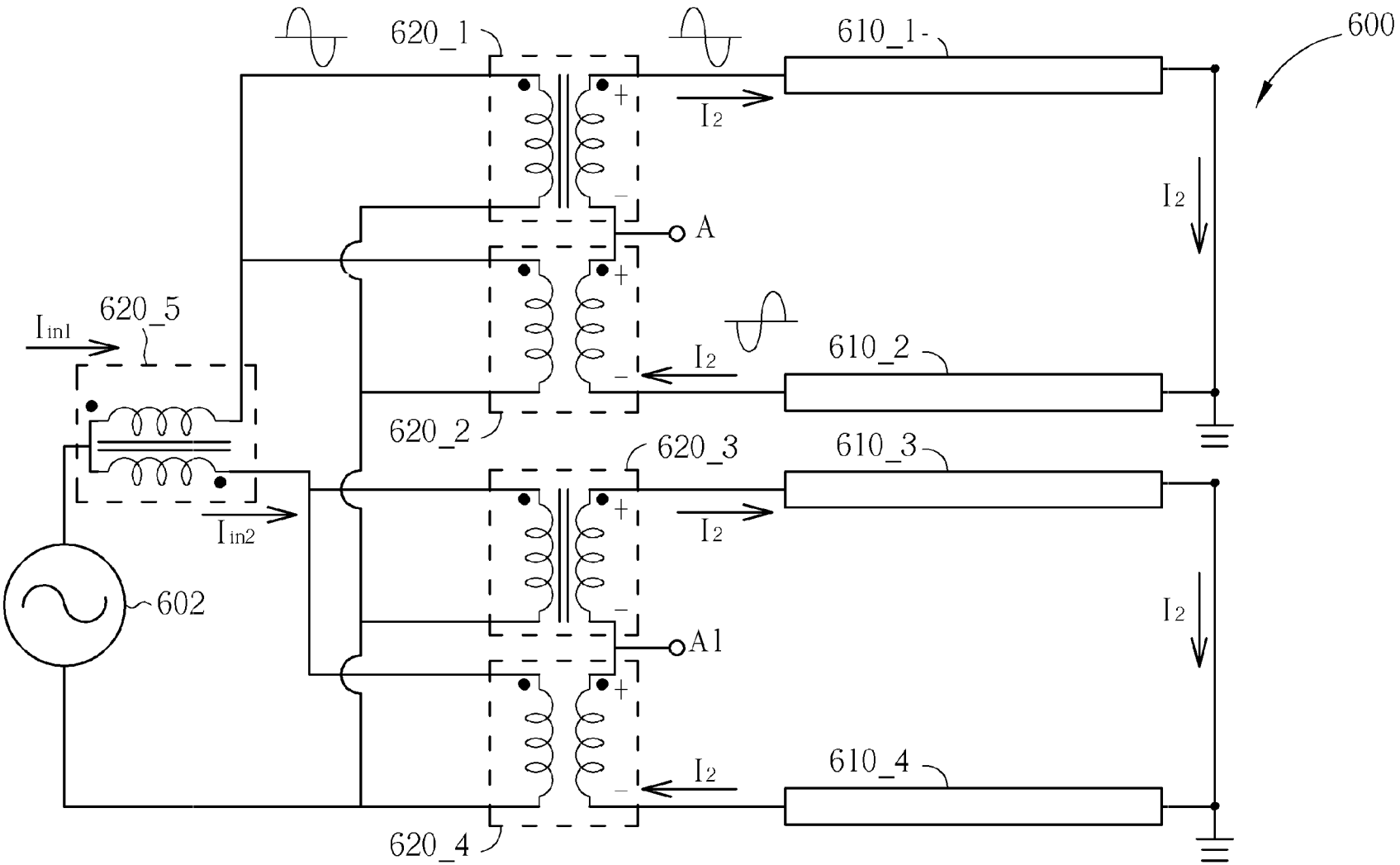
FIG. 6 is a diagram illustrating a backlight module control system according to a second embodiment of the present invention.

Please refer to FIG. 6. FIG. 6 is a diagram illustrating a backlight module control system 600 according to a second embodiment of the present invention. As shown in FIG. 6, the backlight module control system includes a power supply 602, four backlight sub-modules (in this embodiment, four backlight sources 610_1-610_4 serve as the four backlight sub-modules), and five transformers 620_1-620_5. The connections between the backlight sources 610_1 and 610_2 and the transformers 620_1 and 620_2, and the connections between the backlight sources 610_3 and 610_4 and the transformers 620_3 and 620_4 are similar to the connections between the backlight sources 510_1 and 510_2 and the transformers 520_1 and 520_2 shown in FIG. 5. In addition, a primary side of the transformer 620_5 is connected to the transformers 620_1 and 620_2, and a secondary side of the transformer 620_5 is connected to the transformers 620_3 and 620_4. The circuit structure shown in FIG. 6 is for illustrative purposes only, and not meant to be a limitation of the present invention. For example, in other embodiments, a number of the backlight sources can be more than four.

In the backlight module control system 600, numbers of turns of the primary side and the secondary side are designed to be the same (i.e., turns ratio=1), therefore, the currents $I_{in1}$ and $I_{in2}$ respectively at the primary side and the secondary side of the transformer 620_5 are the same. In addition, the transformers 620_1-620_4 are the same transformers, and the currents of the primary sides of the transformers 620_1-620_4 are the same, therefore the secondary sides of the transformers 620_1-620_4 have the same currents $I_2$.

Although it requires an external electrical component (the transformer 620_5) in the backlight module control system 600 to balance the currents of the backlight sources, compared with the prior art backlight module control systems 200, 300 and 400, the backlight module control system 600 can balance the currents of the backlight sources by adding only one transformer, that is, less external electrical components are required. Therefore, the design is simpler and the costs of the design and manufacture are reduced.

In the backlight module control system 600, phases of the backlight sources 610_1-610_4 are (+, −, +, −); that is, currents of two adjacent backlight sources are inverse to each other. When the phases of the backlight sources need to be (+, +, −, −), the following embodiments are used to balance the current of the backlight sources.

Figure 7:
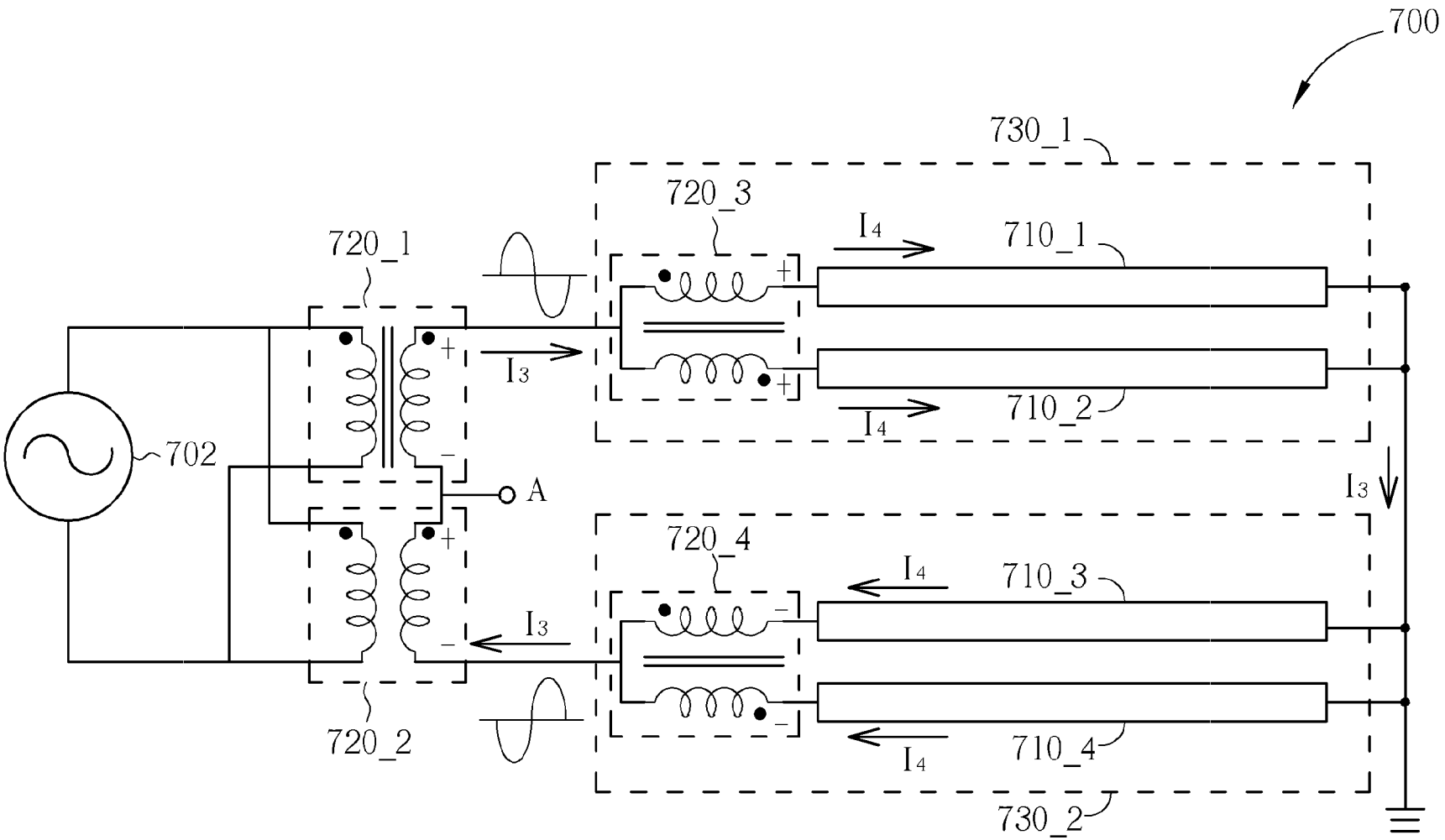
FIG. 7 is a diagram illustrating a backlight module control system according to a third embodiment of the present invention.

FIG. 7 is a backlight module control system 700 according to a third embodiment of the present invention. As shown in FIG. 7, the backlight module control system 700 includes a power supply 702, two backlight sub-modules 730_1 and 730_2, and two transformers 720_1 and 720_2. The backlight sub-module 730_1 includes two backlight sources 710_1 and 710_2 and a transformer 720_3. The backlight sub-module 730_2 includes two backlight sources 710_3 and 710_4 and a transformer 720_4. A primary side and a secondary side of the transformer 720_1 are respectively coupled to the power supply 702 and the transformer 720_3, a primary side of the transformer 720_2 is coupled to the power supply 702, and a secondary side of the transformer 720_2 is coupled to the transformers 720_1 and 720_4. In addition, first sides of the backlight sources 710_1 and 710_2 are respectively coupled to the same polarity connections (positive connections shown in FIG. 7) of a primary side and a secondary side of the transformer 720_3, and first sides of the backlight sources 710_3 and 710_4 are respectively coupled to the same polarity connections (negative connections shown in FIG. 7) of a primary side and a secondary side of the transformer 720_4.

Figure 1:
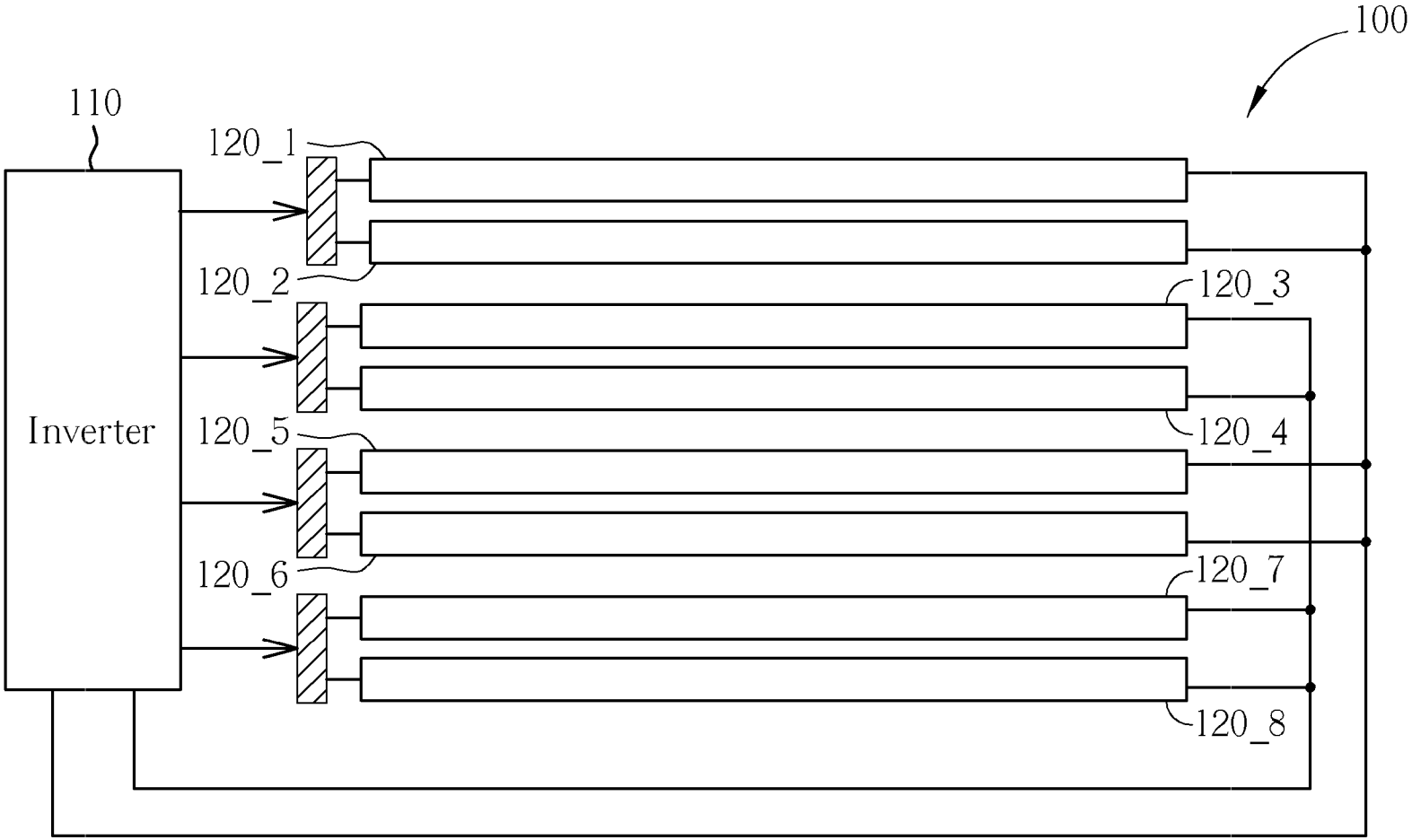
FIG. 1 PRIOR ART
FIG. 1 is a diagram illustrating a prior art backlight module control system.
Figure 2:
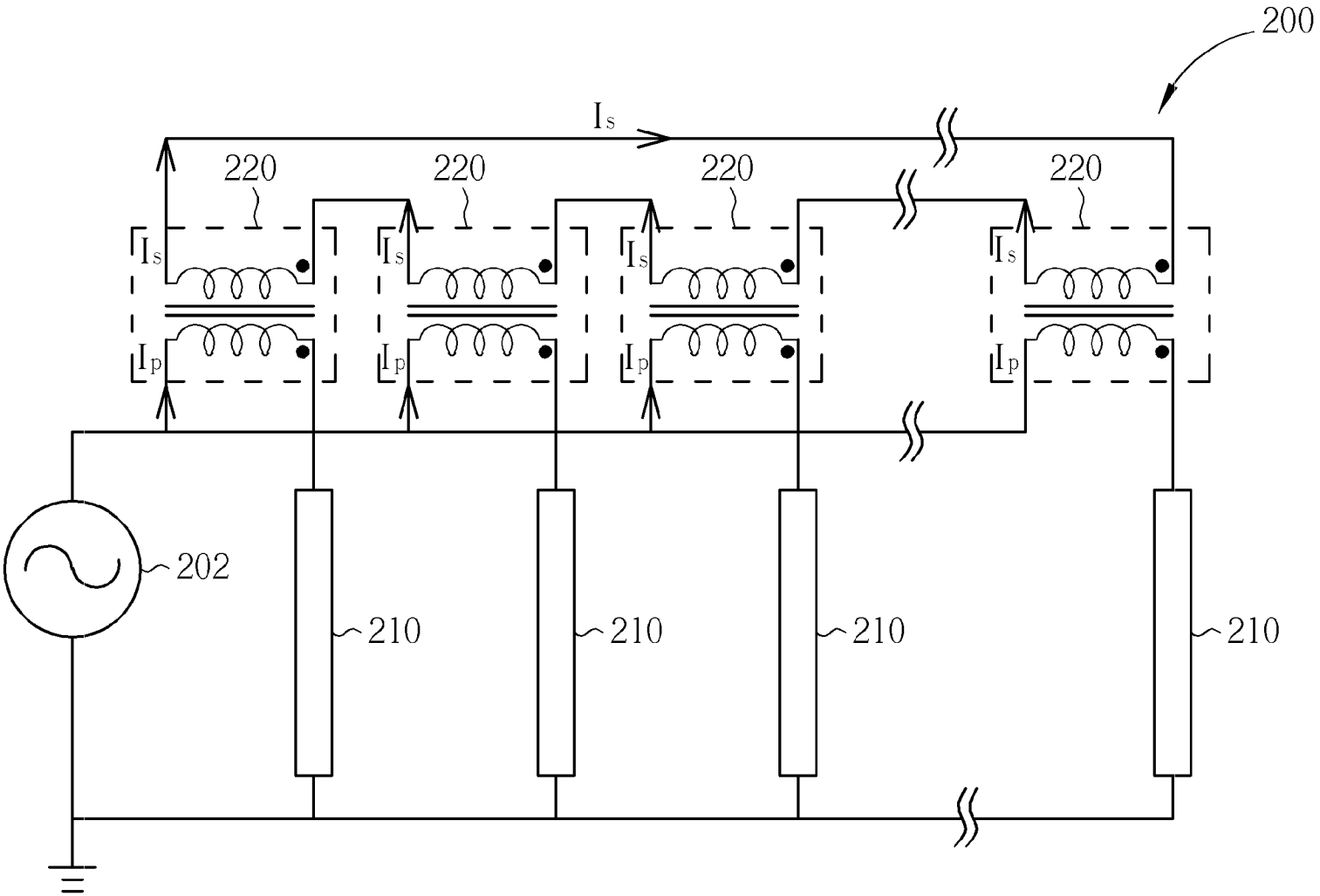
FIG. 2 PRIOR ART
FIG. 2 is a diagram illustrating a backlight module control system using transformers to balance the currents of the backlight sources.
Figure 3:
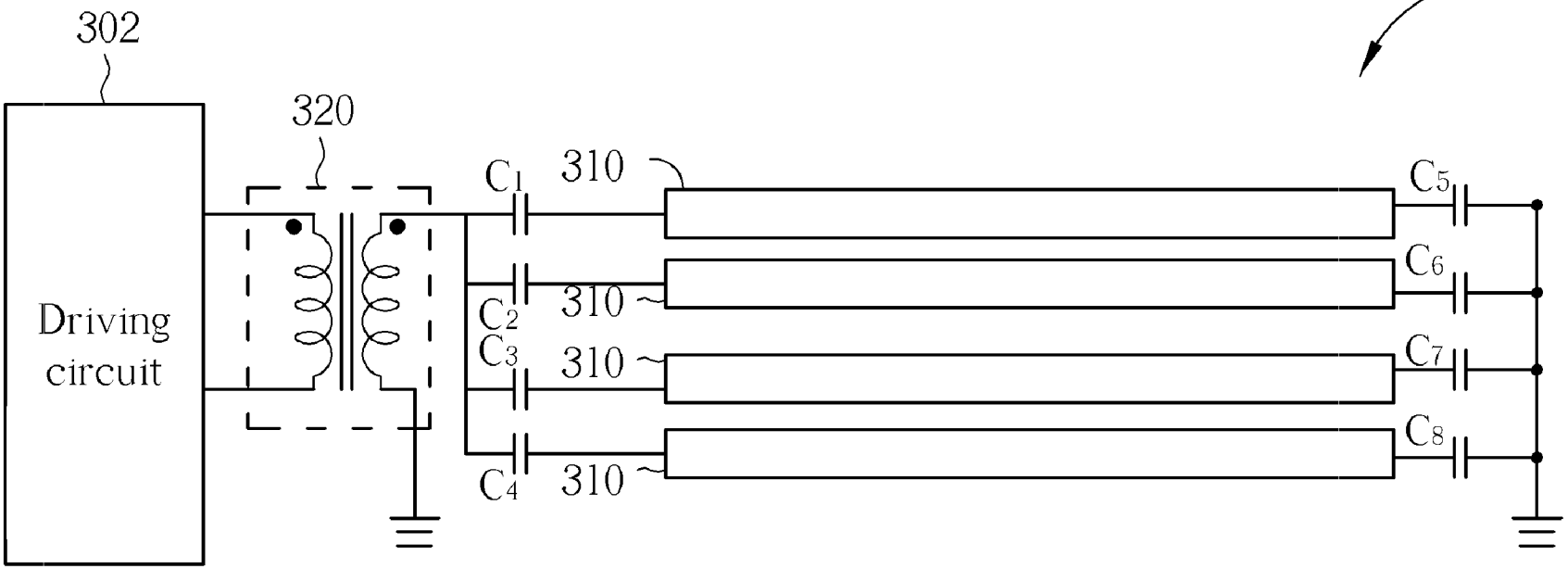
FIG. 3 PRIOR ART
FIG. 3 is a diagram illustrating a backlight module control system using capacitors to balance the currents of the backlight sources.
Figure 4:
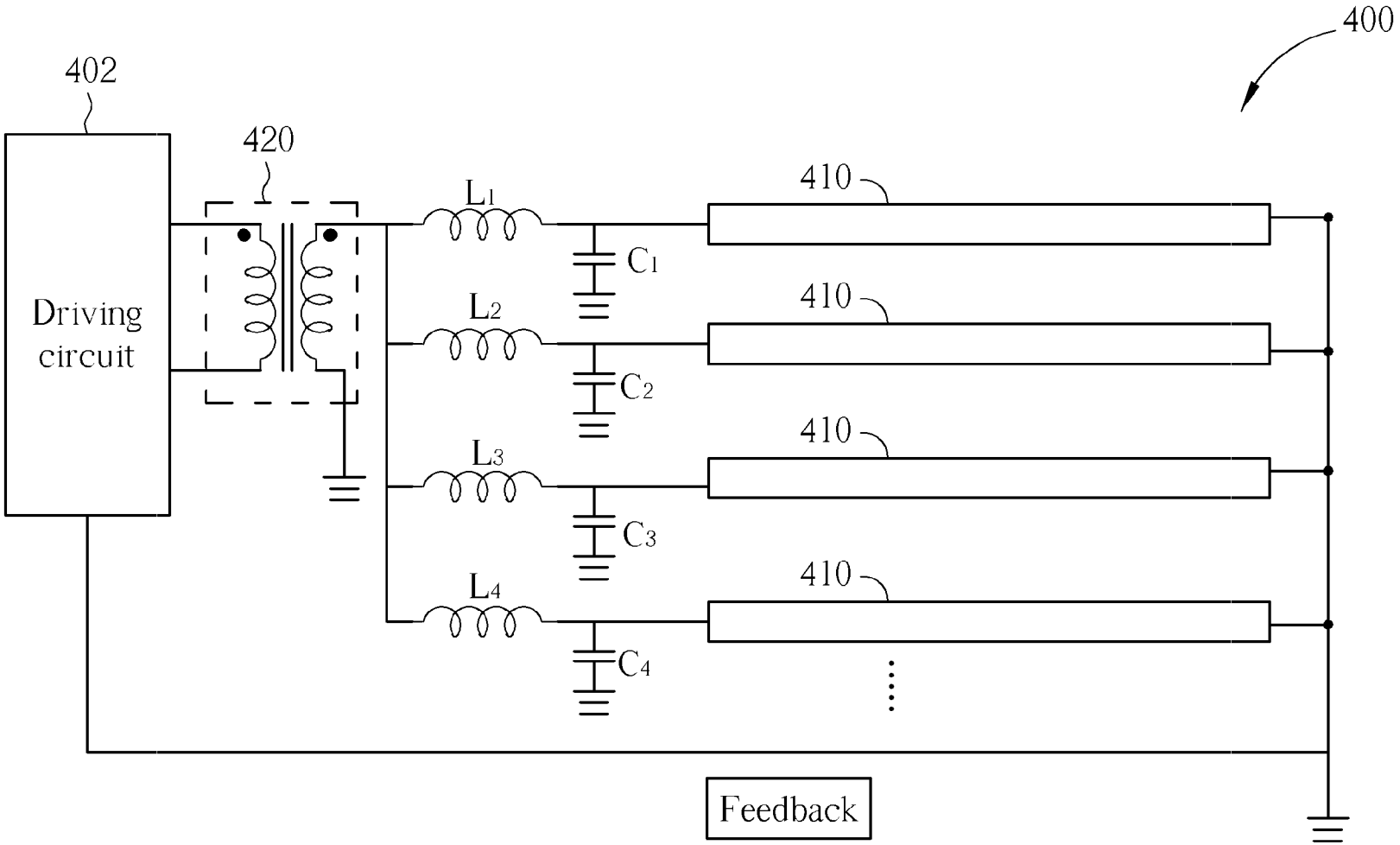
FIG. 4 PRIOR ART
FIG. 4 is a diagram illustrating a backlight module control system using inductors to balance the currents of the backlight sources.

In the backlight module control system 700, when turns ratios of the transformers 720_1 and 720_2 are the same, because the transformer 720_2 is connected to the transformer 720_1 (i.e., node A shown in FIG. 1 is virtual ground), the secondary sides of the transformers 720_1 and 720_2 have the same current $I_3$. In addition, for transformers 720_3 and 720_4, numbers of the turns of the primary side and secondary side are designed to be the same (i.e., turns ratio=1), the backlight sources 710_1-710_4 therefore have the same current $I_4$.

In addition, in the backlight module control system 700, second sides of the backlight sources 710_1-710_4 are connected to ground. The second sides of the backlight sources 710_1-710_4 can also be connected to each other, however, and not connected to other voltage levels.

Figure 8:
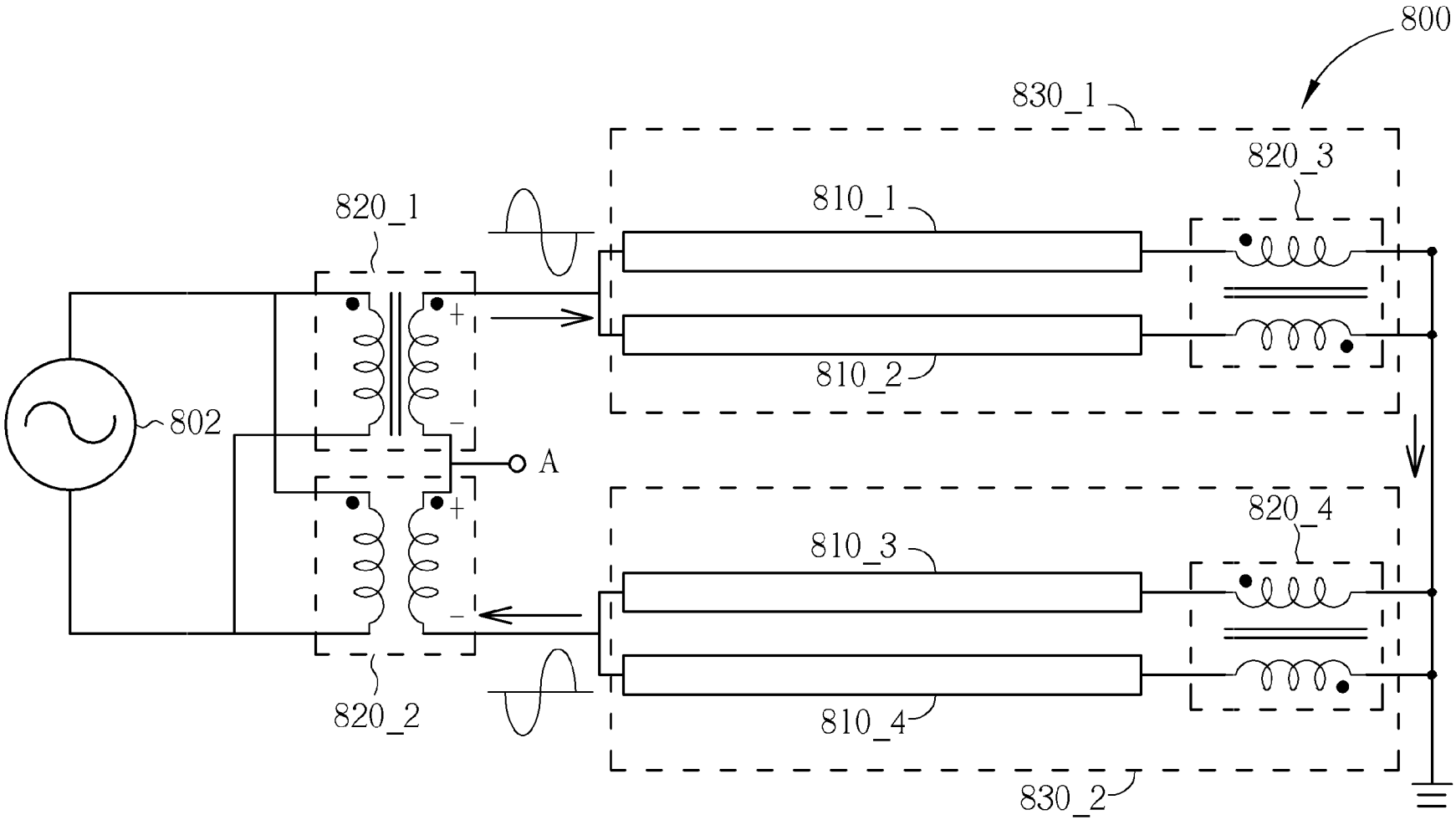
FIG. 8 is a diagram illustrating a backlight module control system according to a fourth embodiment of the present invention.

FIG. 8 is a diagram illustrating a backlight module control system 800 according to a fourth embodiment of the present invention. As shown in FIG. 8, the backlight module control system 800 includes a power supply 802, two backlight sub-modules 830_1 and 830_2, and two transformers 820_1 and 820_2. The backlight sub-module 830_1 includes two backlight sources 810_1 and 810_2 and a transformer 820_3. The backlight module 830_2 includes two backlight sources 810_3 and 810_4 and a transformer 820_4. The backlight module control system 800 is applied when phases of the backlight sources are (+, +, −, −), and its principles and the operations are similar to that of the backlight module control system 700. Further descriptions are therefore omitted here.

Those skilled in the art will readily observe that numerous modifications and alterations of the device and method may be made while retaining the teachings of the invention.

What is claimed is:

1. A backlight module control system, comprising:

a power supply;

a first backlight sub-module;

a second backlight sub-module;

a first transformer, wherein a primary side and a secondary side of the first transformer are respectively coupled to the power supply and a first side of the first backlight sub-module; and a second transformer, wherein a primary side of the second transformer is coupled to the power supply, a secondary side of the second transformer is coupled to the secondary side of the first transformer at a node and a first side of the second backlight sub-module, a voltage level at the node is a virtual ground, and a second side of the first backlight sub-module and a second side of the second backlight sub-module are grounded to a physical ground.

2. The backlight module control system of claim 1, wherein a first polarity connection of the secondary side of the first transformer is coupled to the first backlight sub-module, a second polarity connection of the secondary side of the second transformer is coupled to the second backlight sub-module, and a second polarity connection of the secondary side of the first transformer is coupled to a first polarity connection of the secondary side of the second transformer to ensure that the first and second backlight sub-modules have the same current; the first polarity connection is either a positive connection or a negative connection, and the second polarity connection is the inverse of the first polarity connection.

3. The backlight module control system of claim 1, wherein the first backlight sub-module is a backlight source, and the second backlight sub-module is a backlight source.

4. The backlight module control system of claim 1, wherein the first backlight sub-module comprises:

a third transformer coupled to the first transformer;

a first backlight source, wherein a first side of the first backlight source is coupled to a primary side of the third transformer; and a second backlight source, wherein a first side of the second backlight source is coupled to a secondary side of the transformer, and a second side of the second backlight source is coupled to a second side of the first backlight source;

the second backlight sub-module comprises:

a fourth transformer coupled to the second transformer;

a third backlight source, wherein a first side of the third backlight source is coupled to a primary side of the fourth transformer; and a fourth backlight source, wherein a first side of the fourth backlight source is coupled to a secondary side of the fourth transformer, and a second side of the fourth backlight source is coupled to a second side of the third backlight source.

5. The backlight module control system of claim 4, wherein the first and second backlight source are respectively coupled to the same polarity connections of the primary and secondary sides of the third transformer, and the third and fourth backlight source are respectively coupled to the same polarity connections of the primary and secondary sides of the fourth transformer.

6. The backlight module control system of claim 4, wherein the second sides of the first and second backlight sources are coupled to the second sides of the third and fourth backlight sources.

7. The backlight module control system of claim 1, wherein the first backlight sub-module comprises:

a first backlight source, wherein a first side of the first backlight source is coupled to the secondary side of the first transformer;

a second backlight source, wherein a first side of the second backlight source is coupled to the secondary side of the first transformer; and a third transformer, wherein a primary side and a secondary side of the third transformer are respectively coupled to second sides of the first and second backlight source;

the second backlight sub-module comprises:

a third backlight source, wherein a first side of the third backlight source is coupled to the secondary side of the second transformer;

a fourth backlight source, wherein a first side of the fourth backlight source is coupled to the secondary side of the second transformer; and a fourth transformer, wherein a primary side and a secondary side of the fourth transformer are respectively coupled to second sides of the third and fourth backlight source.

8. The backlight module control system of claim 7, wherein the first and second backlight source are respectively coupled to the same polarity connections of the primary and secondary sides of the third transformer, and the third and fourth backlight source are respectively coupled to the same polarity connections of the primary and secondary sides of the fourth transformer.

9. The backlight module control system of claim 7, wherein the third transformer is coupled to the fourth transformer.

* * * * *